US005785363A

United States Patent [19]

Stopfer et al.

[11] Patent Number: 5,785,363

[45] Date of Patent: Jul. 28, 1998

[54] LATCHING MECHANISM FOR CUPBOARD DOORS AND DRAWERS

[76] Inventors: Joachim Stopfer, Albert-Schweitzer-Strasse 32, D-63179 Obertshausen; Hermann Kraner, Geleitstrasse 60, D-63456 Hanau, both of Germany

[21] Appl. No.: 793,628

[22] PCT Filed: Aug. 9, 1995

[86] PCT No.: PCT/DE95/01054

§ 371 Date: Feb. 11, 1997

§ 102(e) Date: Feb. 11, 1997

[87] PCT Pub. No.: WO96/05393

PCT Pub. Date: Feb. 22, 1996

[30] Foreign Application Priority Data

Aug. 11, 1994 [DE] Germany ..... 44 28 445.4

[51] Int. Cl.[6] ..... E05C 1/12

[52] U.S. Cl. ..... 292/165; 292/DIG. 37; 292/DIG. 65; 312/139

[58] Field of Search ..... 292/165, DIG. 65, 292/DIG. 37; 312/139, 215

[56] References Cited

U.S. PATENT DOCUMENTS

| | | | |
|---|---|---|---|
| 1,369,820 | 3/1921 | Krizs | 292/DIG. 37 |
| 1,906,723 | 5/1933 | Rosendahl . | |
| 2,759,782 | 8/1956 | Goodwin et al. . | |
| 2,924,477 | 2/1960 | Forshey et al. . | |
| 2,936,189 | 5/1960 | Pearson | 292/DIG. 65 |
| 3,519,299 | 7/1970 | Goodwin et al. . | |
| 3,603,657 | 9/1971 | Hassay . | |
| 3,744,830 | 7/1973 | Levack | 292/DIG. 65 |
| 3,893,721 | 7/1975 | Upton . | |
| 5,156,027 | 10/1992 | Reusch | 292/DIG. 65 |
| 5,172,575 | 12/1992 | Fisher . | |
| 5,390,516 | 2/1995 | Alchin | 292/DIG. 37 |

FOREIGN PATENT DOCUMENTS

| | | |
|---|---|---|
| 952118 | 11/1949 | France . |
| 7837900 | 4/1979 | Germany . |
| 3408791 | 9/1985 | Germany . |
| 9214278 | 3/1993 | Germany . |

OTHER PUBLICATIONS

PCT Internation Patent Application No. WO 96/05398 Published on Feb. 22, 1996.

*Primary Examiner*—Flemming Saether
*Attorney, Agent, or Firm*—Young & Basile, P.C.

[57] ABSTRACT

The invention relates to a closure device for cabinet doors and drawers, which serves in particular as securement against unauthorized actuation by children. On the outside of a cabinet door or drawer, two push-buttons are herein provided the spacing of which from each other is greater than the distance which can be bridged by the hand of a child. Only if both push-buttons are actuated can the cabinet door or drawer be opened.

17 Claims, 4 Drawing Sheets

LATCHING MECHANISM FOR CUPBOARD DOORS AND DRAWERS

BACKGROUND OF THE INVENTION

The invention relates to a closure device or latching mechanism for cabinet doors and drawers.

As a rule, cabinet doors and drawers can readily be opened from the outside. However, this is especially of disadvantage if objects are disposed within the cabinets, which are not intended to be accessible to everyone, and especially not to children. Among these objects are knives and forks, cleaning agents or medications.

A closure for drawers is already known which is said to ensure that food items disposed in the drawer do not dry out (U.S. Pat. No. 1,906,723). In the case of this drawer closure, however, a complex and additional mechanism is necessary since the drawer is to be closed airtight.

Furthermore, a securement device for gates or the like is known in which a drive with two sides is required (DE 92 14 278.8 U). This securement device, moreover, comprises a locking latch movable by the force of a spring in a recess. This securement device, primarily intended for gates which can be raised and lowered in lateral rails, is not suitable for the securement of cabinet doors and drawers.

In a known childproof closure for cabinets disposed under sinks, which does not require a key and yet cannot be opened by children, a snap closure is provided which is actuated via a wire pull by means of a pull knob (DE 34 08 791 A1). The pull knob is disposed such that the distance between pull knob and door handle is so large that with an infant's hand, it is not simultaneously possible to reach the two, as is required for opening the door.

Further is known a snap latch-bar device for doors and gates which comprises a guide housing and an actuation housing connected with each other (DE 78 37 900 U). In the guide housing is disposed a latch bar which at its one end bears a snap latch-bar which is prestressed into a locking position by a helical compression spring. At the other end of the snap latch-bar is disposed a yoke which is located in the actuation space. This yoke is part of a double-action actuating mechanism, which comprises a rotatable press-keyed nut and two press-keyed nut arms. When rotating the press-keyed nut, the latch bar is pulled downwardly regardless of whether or not the press-keyed nut is rotated in the clockwise or in the counterclockwise direction. This known device is too complicated for a child safety mechanism since it requires a tool in order to rotate the press-keyed nut.

Furthermore is known a closure for a medicine cabinet which can only be opened with the aid of two hands (U.S. Pat. No. 2,759,782). On the medicine cabinet are provided two slide levers of which the one must be moved horizontally and the other vertically in order to open the door of the medicine cabinet. If they are operated with the finger and thumb of one hand, the door does not open because the resulting forces are directed away from the suspension of the door. In order to open the door, the second hand must be used additionally.

In the case of another known snap-in mechanism for cabinets and the like, means are provided which permit adults, but not children, to open a door (U.S. Pat. No. 2,924,477). This snap-in mechanism comprises two snap elements which are affixed on the cabinet with one of these elements being fastened on the housing frame and the other element on the door. In addition, this mechanism comprises two actuation members rotatably disposed in the cabinet and comprising levers projecting from a side wall so that they are accessible from the outside. These levers are partially encompassed by a covering with an opening which permits limited access to the levers. In order to open a door, thumb and finger of a person must be inserted into said openings and the levers must be pressed together. A child with smaller fingers is not capable of inserting its fingers sufficiently far into said openings.

Further a security closure for containers, in particular medicine cabinets, is known, which makes it impossible for children to open a door (U.S. Pat. No. 3,519,299). The security closure comprises a locking as well as an unlocking mechanism on the container and a portion of the unlocking mechanism projects from the container. The portion of the unlocking mechanism disposed in the container is associated with the locking mechanism while the other portion comprises an enlarged gripping surface which is greater than the normal reach of a small child, but smaller than the reach of the hand of an adult. Furthermore, an additional unlocking mechanism is provided on the container which cooperates with said unlocking mechanism.

A further safety closure intended for medicine cabinets is used in a refrigerator (U.S. Pat. No. 3,603,657). This refrigerator includes a safety shelf for medications which must be stored at low temperatures. The locking mechanism of this safety shelf is an invisible and integral part of the refrigerator door. It is opened by merely touching or pressing one or several sites on the door. As actuation elements two push-buttons are preferably provided which, upon being actuated simultaneously, close a circuit whereby a door is opened.

Another known securing closure for a medicine box comprises a first and a second set of push-buttons and each set comprises two push-buttons and each push-button within the set is disposed at an interval from another push-button (U.S. Pat. No. 3,893,721). This interval is greater than the average interval between the thumb and any other finger at one hand of a child but smaller than the average interval between the thumb and any other finger of an adult.

Lastly, a pistol case with a security lock is known which cannot be defeated by a child (U.S. Pat. No. 5,172,575). In order to open this case, it is necessary to place two of four feet of the case onto a level surface so that they are activated. Any person not understanding the role of the feet of the case in opening or closing, is unable to open this case.

SUMMARY OF THE INVENTION

The invention therefore addresses the problem of creating a latching mechanism for cabinet doors, drawers or the like which can be operated readily by adults and not at all by children.

The advantage achieved with the invention resides in particular therein that the child-proofing mechanisms does not require any special opening aids. Rather, the fact is utilized that a child's hand is smaller than that of an adult and, accordingly, does not have a reach greater than a specific distance. In practice, this distance marked by two buttons is between 0 and 150 mm, preferably between 80 and 130 mm. Moreover, it is additionally possible to adjust the force required to overcome the securement. This force is adjusted so that it cannot be brought to bear by children.

BRIEF DESCRIPTION OF THE DRAWINGS

An embodiment of the invention is depicted in the drawings and will be described in further detail in the following.

DETAILED DESCRIPTION OF THE PREFERRED EMBODIMENT

Figure 1:
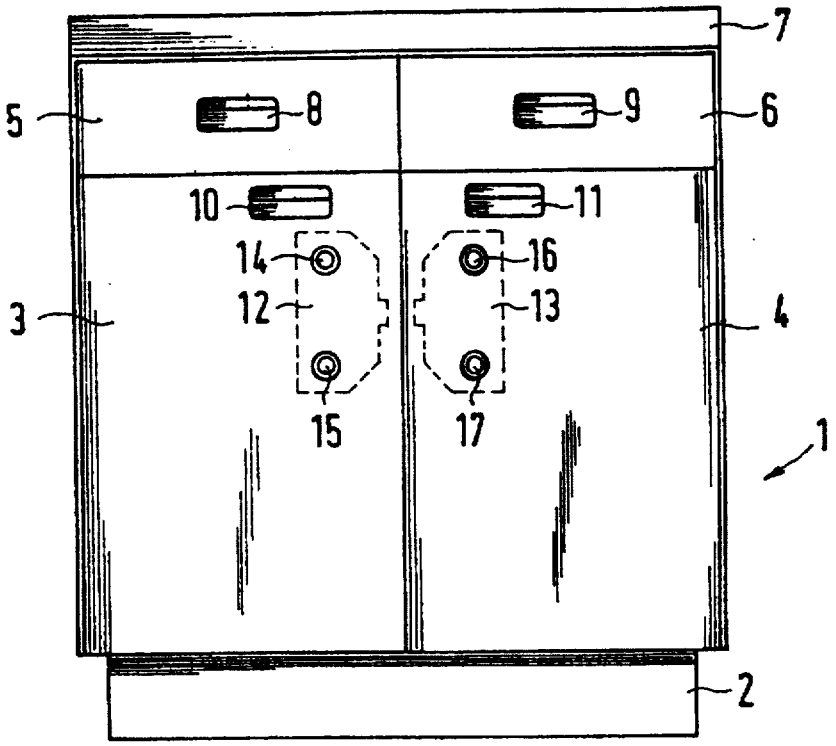
FIG. 1 is a lower kitchen cabinet with two locking devices according to the invention.

In FIG. 1 is shown the front of a cabinet under a sink 1, comprising a base 2, two doors 3, 4, two drawers 5, 6 and a working plate 7. The drawers 5, 6 as well as also the doors 3, 4 are each provided with a recessed grip 8, 9; 10, 11. Behind each door 3, 4 one locking device 12, 13 is provided, each of which comprises two operating buttons 14, 15 or, respectively, 16, 17. The spacing of these buttons 16, 17 from each other is therefore selected such that they cannot be operated simultaneously by a child's hand. A distance of 80 to 130 mm is sufficient for this purpose. The buttons 14, 15 also have the same spacing as the buttons 16, 17. It is harmless if a child can simultaneously actuate with both hands the buttons 14, 15 or, respectively, 16, 17, since he needs one more hand in order to pull open the door at the recessed grip 10, 11. In order to open one door 3 or 4 it is required to oppose at the recessed grips 10, 11 the forces acting on the buttons 16, 17 with a counterforce.

Figure 2:
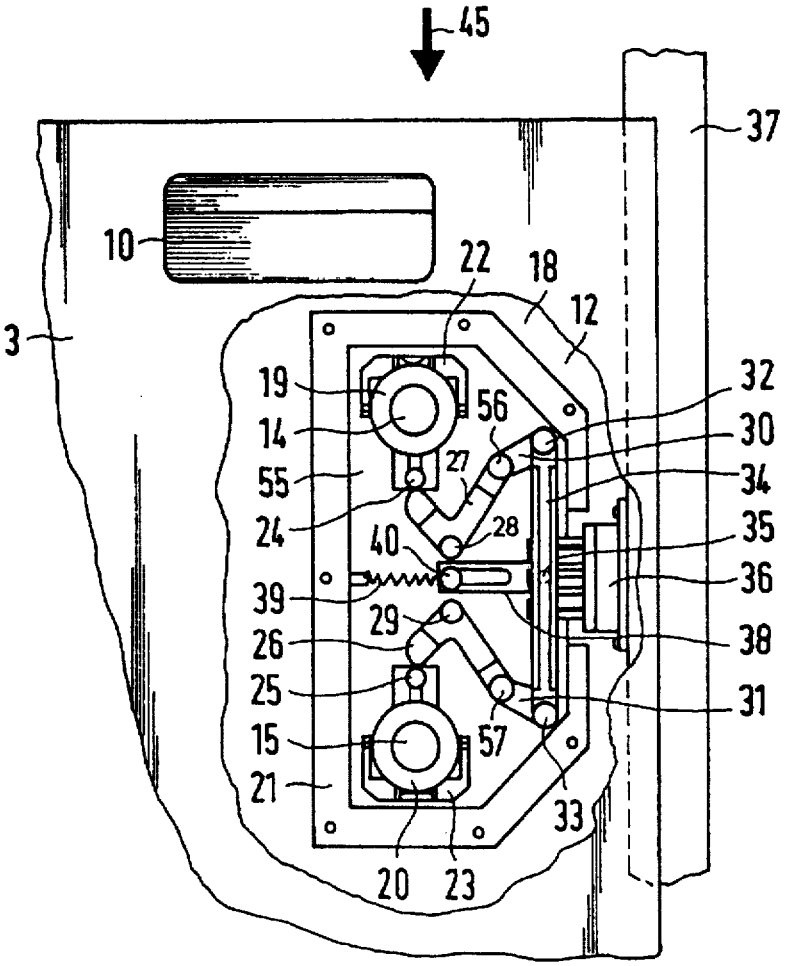
FIG. 2 is a cut-away partial view of the lower kitchen cabinet, in which a locking mechanism is shown.

In FIG. 2 the door 3 is shown broken at a site 18 so that the locking mechanism 12 can be seen clearly. The buttons 14, 15 are herein supported in guides 19, 20 in each of which is disposed a compression spring which, however, is not visible in FIG. 2. Both buttons 14, 15 are disposed within a housing 21 which comprises an opening on one side. This housing 21 is shown in further detail in FIG. 3. Under the guides 19, 20 are disposed slide bars 22, 23 which are guided on the housing bottom 55 by guide bolts 24, 25. At the front end of a slide bar 22, 23 where the guide bolts 24, 25 are disposed, is provided in each case an angled lever 26, 27 rotatable about an axle 28, 29 with the aid of the slide bar. The angled levers 26, 27 are each connected via an articulation 56, 57 with an intermediate lever 30, 31 at the ends facing away from the slide bars 22, 23, which intermediate lever is coupled via bolts 32, 33 with the ends of a carrier 34. This carrier 34 comprises an elongated bridge piece with edge elevations on both sides which serve for strengthening and stabilizing the carriers comprising synthetic material. In the center of the carrier 34 is provided a bolt 35 connected with a locking bar 38. A snap-in stop element 36 is fastened on a strip 37, which engages the locking bar 38. The locking bar 38 is additionally connected to a compression spring 39. A guide pin 40 is inserted through a slot of the locking bar 38 so that the locking bar 38 can be moved back and forth.

Figure 3:
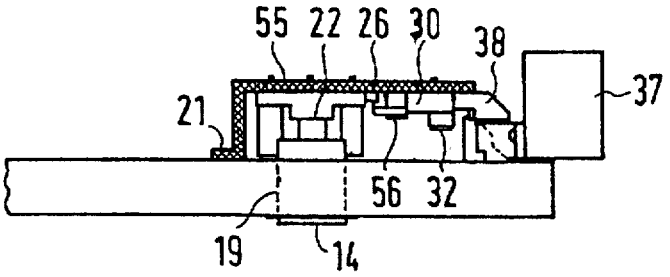
FIG. 3 is a top view onto the cabinet under the sink with a portion of the locking mechanism.

In FIG. 3 the door 3 with the locking device 12 is shown in a view from above, i.e. the view corresponds to the direction of arrow 45 in FIG. 2. Herein the button 14 with the guide 19 as well as the strip 37 is shown. The housing 21 with the housing bottom 55 delimits the mechanism with respect to the interior of the cabinet under the sink. On the housing bottom 55 are disposed the axle 56, the bolt 32, and the intermediate lever 30. The slide bar 22 is disposed next to the axle 56 and under the guide 19. The end of the locking bar 38 is also depicted.

Figure 4:
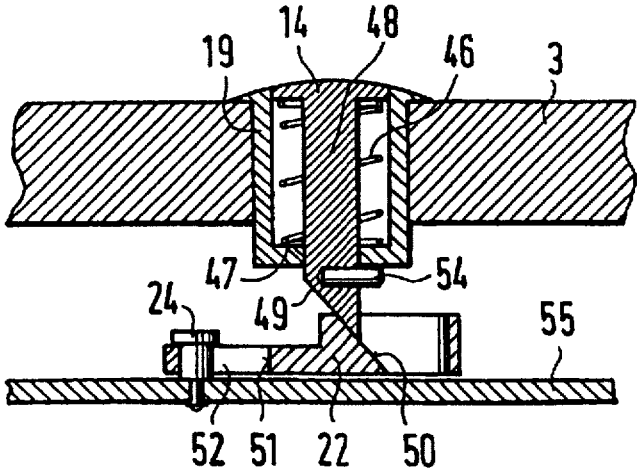
FIG. 4 is a section through a slide bar and an actuation button.

FIG. 4 shows a detailed view of the button 14 disposed in guide 19 of door 3. In guide 19 is disposed a compression spring 46 which is braced against the bottom 47 of guide 19 and which exerts pressure against the underside of button 14. Button 14 together with a square bolt forms a common part which is bevelled at its lower end. The bevel 49 of the square bolt 48 corresponds to a bevel 50 of the slide bar 22. If the button 14 is pushed, the latter moves within guide 19 in the downward direction and the spring 46 is compressed. Simultaneously, the square bolt 48 is displaced in the downward direction and the slide bar 22 is thereby moved to the left. This motion of slide bar 22 is terminated when the pin 24 abuts the wall 51 of opening 52. A securement pin 54 is intended to prevent the button 14 from popping out in the upward direction.

Figure 5:
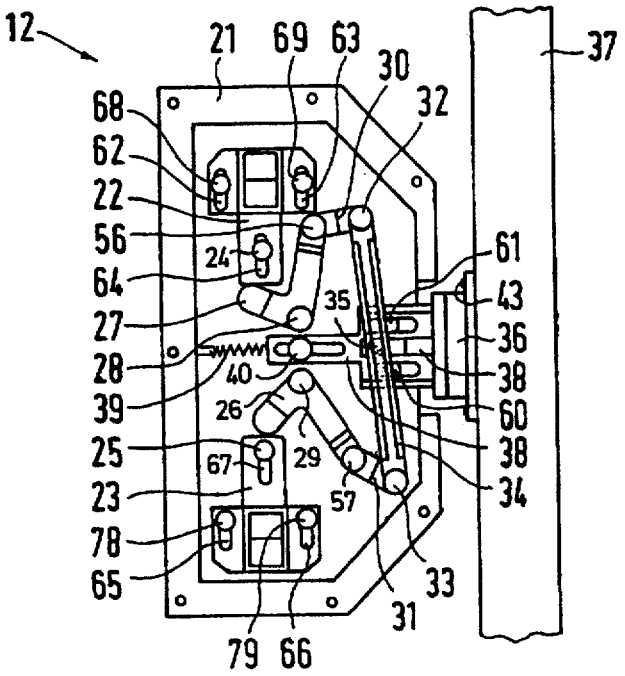
FIG. 5 is the locking mechanism after pressing only one button.

The locking device 12 of FIG. 1 is again depicted in FIG. 5 and specifically at a point in time at which the button 14 associated with slide bar 22 has been depressed. Buttons 14, 15 are not shown herein in order to reveal the slide bars 22, 23 associated with these buttons 14, 15. It can be seen in FIG. 5 that the slide bar 22 has been moved out and that in so doing it has rotated the angled lever 27 about the axle 28. Locking bar 38 is hereby pulled into housing 21, i.e. it is pulled away from the snap-in stop element 36 against the force of spring 39. This pulling-away, however, is insufficient to open the door 3 because by pressing only button 14, the carrier 34 is rotated about bolt 33 only so far that the locking bar 38 coupled via the bolt 35 with the carrier 34 is only displaced at the site of bolt 35 by half of the path required for unlocking.

As can be seen in FIG. 5 each of the two slide bars 22, 23 is provided with three elongated holes 62, 63, 64 or, respectively, 65, 66, 67, in which guide bolts 24, 68, 69 or, respectively, 25, 78, 79 are disposed.

Figure 6:
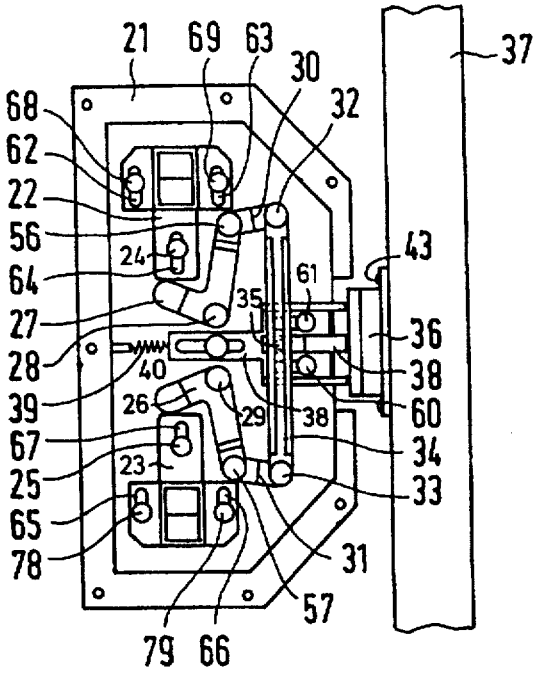
FIG. 6 is the locking mechanism after pressing two buttons.
Figure 8:
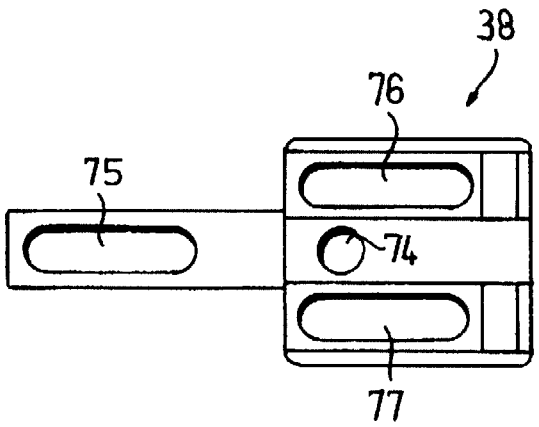
FIG. 8 is a locking bar.

FIG. 6 shows the same device as FIG. 5, however, at a point in time at which both buttons 14 and 15 are depressed. If only button 14 is depressed, then—as already described in connection with FIG. 5—only slide bar 22 is moved. This slide bar 22 presses against the angled lever 27 which can be pivoted about axle 28. Since this angled lever 27 is connected through an articulation 56 with the intermediate lever 30, which, in turn, is connected via a bolt 32 acting as articulation with the carrier 34, the carrier 34 is pulled in the direction toward slide bar 22. The locking bar 38 coupled with carrier 34 in the process is pulled slightly back. The locking bar 38 guided by guide bolts 40, 61, 60 and fastened on housing bottom 55, thus leaves its starting position at a locking bar stop element 43 whereby, however, no complete unlocking is effected.

But, when pressing the second button 15, the slide bar 23 associated with this second button 15—guided by bolts 25, 78, 79—is moved and rotates the angled lever 26 in the same way as angled lever 27 is rotated by slide bar 22.

Through this rotary motion of the angled lever 26 the intermediate levers 31 and the carrier 34 are moved. The carrier 34 is now in its center, defined by the carrier bolt 35 for the locking bar 38, displaced by the twofold magnitude. This twofold magnitude is sufficient to remove the locking bar 38 completely from the snap-in stop element 36. Therewith the door 3 is unlocked and can be opened by pulling the recessed handle 10.

In order to be able to open the cabinet door 3, thus, for one, the distance between the two buttons 14, 15 must be bridged with the one hand and with the other hand the door 3 must be pulled. As a rule, for bridging the distance index finger and thumb are required. If the distance is more than 130 mm, it can, as a rule, only be bridged by the hand of an adult. It is also not sufficient to press buttons 14, 15 only slightly; rather, they must be depressed so far that the slide bars 22, 23 can travel the path required to unlatch the locking bar 38. Thus, each one of the buttons 14, 15 contributes to one half of the path of the locking bar 35. If only one button is pressed, the locking bar 35 is shifted by only one half out of the locking position and the locking system continues to remain locked.

If both buttons 14, 15 are released after the opening, the locking bar 38 is pushed back into the starting position by the compression spring 39, i.e. the door is locked again. In order to close the cabinet door 3, it is simply pushed shut. Hereby, the locking bar 38 snaps into the locking bar stop element 43 and locks the door.

Figure 7A:
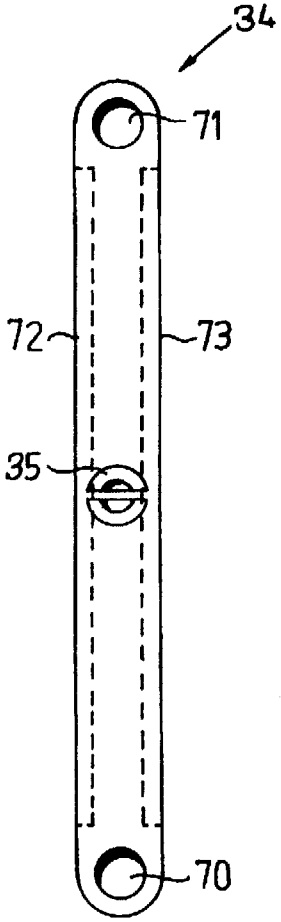
FIG. 7*a* is a top view of the carrier for a locking bar.
Figure 7:
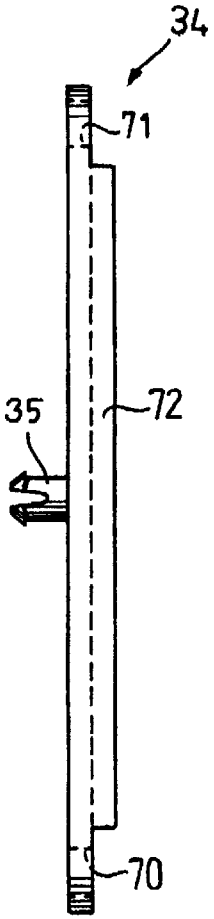
FIG. 7 is a side view of a carrier for a locking bar.

In FIG. 7 and FIG. 7*a* the carrier 34 is again depicted in a top view (FIG. 7*a*) and in a side view (FIG. 7). It is evident that the carrier 34 comprises at each end a bore 70, 71 and is provided in its center with bolt 35. Two reinforcement ribs are denoted by 72, 73.

Locking bar 38 comprises a bore 74 which bolt 35 of carrier 34 engages. In addition, the locking bar 38 is provided with three elongated holes 75, 76, 77 which the guide bolts 40, 60, 61 engage. The locking bar 38 is usefully bevelled at its end so that it can be moved by pushing against the snap-in stop element 36. This allows the locking bar 38 to snap in when pressure is exerted against door 3.

The carrier 34 is shown in FIGS. 5 and 6, depicting to view, above the locking bar 38 so that its stud 35 projects downwardly and moves through hole 74.

We claim:

1. A closure device for cabinet doors and drawers having two unlocking elements on each cabinet door or drawer, wherein both unlocking elements can be actuated simultaneously with two fingers of a hand of an adult, comprising:

push-buttons as unlocking elements, slide bars each connected with a push-button, wherein said slide bars deflect a force acting upon the push-buttons, angled levers, wherein each lever is functionally connected with one slide bar, and a locking bar actuated by the angled levers.

2. The closure device as stated in claim 1, wherein the distance between two of said buttons is preferably between 80 mm and 130 mm.

3. The closure device as stated in claim 1, wherein a first button is displaceable for displacing a first slide bar, wherein said first slide bar actuates a first angled lever functionally connected with the locking bar.

4. The closure device as stated in claim 3, wherein the functional connection between an angled lever and the locking bar includes a carrier, said carrier having two ends and a center wherein each end is coupled to one of the angled levers and said center is connected to the locking bar.

5. The closure device as stated in claim 4, wherein an intermediate lever is provided between each of the angled lever and the ends of the carriers, wherein said intermediate lever is connected with the angled levers and the carrier.

6. The closure device as stated in claim 4, wherein the locking bar comprises a through-bore, wherein said through-bore engages a projection of the carrier.

7. The closure device as stated in claim 4, wherein the locking bar is connected to a spring.

8. The closure device as stated in claim 3 wherein the button has an underside, and the button is displaceable within a guide.

9. The closure device as stated in claim 8, wherein the guide comprises a hollow body with a bottom and between the bottom of the hollow body and the underside of the button is a spring.

10. The closure device as stated in claim 9, wherein the spring encompasses the shaft.

11. The closure device as stated in claim 8, wherein the button has a shaft on its underside, said shaft has a lower end, said shaft has a bevel at its lower end and said shaft projects through an opening in the bottom of the guide.

12. The closure device as stated in claim 11, wherein said slide bar has a bevel thereon and the bevel of the shaft is functionally interactive with the bevel on the slide bar.

13. The closure device as stated in claim 11, wherein the shaft includes a securement pin which abuts the underside of the bottom of the guide when the button is released.

14. The closure device as stated in claim 3 wherein the slide bar is T-shaped having a middle bridge piece and lateral bridge pieces, wherein said bridge pieces have a guide bolt for engaging elongated holes.

15. The closure device as stated in claim 3 wherein the locking bar is disposed with two adjacent elongated holes and a third elongated hole spaced apart therefrom wherein said guide bolts engage said elongated holes.

16. The closure device as stated in claim 1, wherein a second button is displaceable and displaces a second slide bar, wherein said second slide bar actuates a second angled lever functionally connected with the locking bar.

17. A closure device for a cabinet having cabinet doors and drawers and having two unlocking elements on each cabinet door or drawer, wherein both unlocking elements can be activated simultaneously with two fingers of a hand of an adult, the combination comprising:

push-buttons as unlocking elements;

slide bars each connected with a push-button, wherein said slide bars deflect a force acting upon the push-buttons;

angled levers, wherein each lever is functionally connected with one slide bar;

a locking bar activated by the angled levers; and an operating element for pulling away the cabinet door or drawer from the cabinet.

* * * * *